United States Patent [19]

London

[11] Patent Number: 4,946,384

[45] Date of Patent: Aug. 7, 1990

[54] GAS PILOT-IGNITER FOR BURNERS

[76] Inventor: Paul W. London, 6217 Manchester La., Bakersfield, Calif. 93309

[21] Appl. No.: 254,840

[22] Filed: Oct. 7, 1988

[51] Int. Cl.[5] ..... F23D 14/70; F23D 14/00

[52] U.S. Cl. ..... 431/349; 431/263; 431/264; 431/354; 60/39.826

[58] Field of Search ..... 431/158, 263, 264, 265, 431/278, 350, 353, 354, 254, 258, 260, 349; 60/39.821, 39.826, 39.827, 39.828, 732, 749

[56] References Cited

U.S. PATENT DOCUMENTS

| | | | |
|---|---|---|---|
| 1,380,997 | 6/1921 | Metcalfe . | |
| 1,436,433 | 11/1922 | Coberly | 431/354 |
| 1,596,609 | 8/1926 | Gault, Jr. | 431/354 |
| 1,995,099 | 3/1935 | Herr | 431/263 X |
| 2,410,881 | 11/1946 | Hunter | 431/263 |
| 2,423,410 | 7/1947 | Simmons | 431/263 X |
| 2,448,595 | 9/1948 | Holbrook | 431/263 X |
| 2,487,353 | 11/1949 | McLemore . | |
| 2,521,541 | 9/1950 | Schneible et al. . | |
| 2,644,512 | 7/1953 | Durr et al. . | |
| 2,695,053 | 11/1954 | Huber et al. . | |
| 2,717,637 | 9/1955 | Huber . | |
| 2,843,197 | 7/1958 | Snyder | 431/263 |
| 3,431,057 | 3/1969 | Reed | 431/263 |
| 3,574,499 | 4/1971 | Turpin et al. . | |
| 3,787,169 | 1/1974 | Gjerde . | |
| 3,804,578 | 4/1974 | Robbins . | |
| 4,120,639 | 10/1978 | Thekdi et al. . | |
| 4,288,978 | 9/1981 | Wyatt | 60/39.826 X |
| 4,315,298 | 2/1982 | Mulkins et al. | 431/264 X |
| 4,804,324 | 2/1989 | Yoshinaga | 431/354 X |

*Primary Examiner*—Carl D. Price

*Attorney, Agent, or Firm*—Christie, Parker & Hale

[57] ABSTRACT

A gas pilot-igniter is used for igniting combustible gases in a burner, particularly high velocity gas streams. The gas pilot-igniter includes an air inlet manifold for supplying air under pressure to a mixing venturi, a fuel gas manifold for directing fuel into the venturi for primary mixing with air, and a pre-combustion chamber in a main combustion chamber. The pre-combustion chamber is formed by a baffle placed in the path of the flow stream of the fuel/air mixture for creating turbulence and secondary mixing. In addition, the baffle guides the fuel/air mixture to an igniter, such as a spark plug, for igniting the fuel/air mixture to produce a pre-combustion flame. The fuel/air mixture also flows around sides of the baffle and into the main combustion chamber where it is ignited by the pre-combustion flame, producing a constantly regenerated pilot flame which exits a pilot output nozzle to ignite the main burner fuel/air mixture.

11 Claims, 3 Drawing Sheets

GAS PILOT-IGNITER FOR BURNERS

FIELD OF THE INVENTION

This invention relates to gas pilots or igniters for burners, and more particularly to a gas pilot-igniter for use in igniting high velocity gas/air flow streams in combustion chambers of burners.

BACKGROUND OF THE INVENTION

Prior art gas pilots, igniters, or torches generally do not provide acceptable performance in high velocity fuel/air streams, since the pilot flame is often blown out by the high velocity flow stream before ignition can occur. It is desirable to use a variety of fuel gases since fuel costs and availability require this flexibility. Prior art gas pilots and igniters operate over a very narrow range of air and gas flow rates and pressures and perform very poorly with lower BTU content fuel gases. This eliminates many available fuel sources from use in gas pilots or igniters. It is also necessary for prior art gas pilots or igniters to be operated with an extremely rich fuel/air mixture which frequently results in fouled spark plugs.

Thus, there is a need to provide a high velocity gas pilot-igniter which will operate reliably in high velocity flow streams without being blown out by the high velocity flow. There is also a need to operate on very lean fuel-air mixtures without flameout and to burn dirty or low BTU content gases without flameout. It is also desirable for the gas pilot-igniter to tolerate fluctuating fuel pressures or fuel qualities, to ensure good fuel-air mixing, and produce good flame strength for a variety of fuel gases.

SUMMARY OF THE INVENTION

This invention provides a gas pilot-igniter for burners capable of burning fuel/air mixtures over a broad range using a variety of combustible gases, while producing an igniting flame which survives the high velocity gas flow of the main burner fuel/air mixture without flameout.

Briefly, one embodiment of the gas pilot-igniter includes an air inlet for supplying air under pressure to a mixing venturi, a fuel gas inlet for directing fuel gas under pressure into the venturi for primary mixing, and a pre-combustion chamber formed in a portion of a main combustion chamber downstream from the primary mixing chamber. The pre-combustion chamber is formed by a baffle placed in the path of the flow stream of the fuel/air mixture from the primary mixing venturi for creating turbulence and secondary mixing. In addition, the baffle guides the fuel/air mixture to an igniter, such as a spark plug, for igniting the fuel/air mixture to produce a pre-combustion flame. A portion of the fuel-/air mixture also flows around the sides of the baffle from the pre-combustion chamber and into the main combustion chamber where it is ignited by the pre-combustion flame, producing a pilot flame which exits the pilot outlet nozzle to ignite the main burner fuel/air mixture.

By producing good primary and secondary mixing of the fuel and air, and by constantly directing the resulting mixture toward the igniter while a portion of the mixture flows around the baffle to the primary combustion chamber, the pilot flame is constantly regenerated and good flame strength is produced. The efficient mixture of gas and air and resulting ignition allows use of a variety of fuel gases.

These and other aspects of the invention will be more fully understood by referring to the following detailed description and the accompanying drawings.

DETAILED DESCRIPTION

The gas pilot-igniter of the present invention is used for igniting fuel-air flow streams in burners, industrial furnaces, boilers, oil heaters, steam generators, emulsion treaters, driers, air heaters, vaporizers, liquid asphalt heaters, incinerators, aluminum reverbs, flare stack igniters, and the like. For simplicity, the gas pilot-igniter is considered applicable to industrial burners in general in which a main burner fuel/air mixture is ignited by an igniting flame produced by the gas pilot-igniter of this invention.

Figure 1:
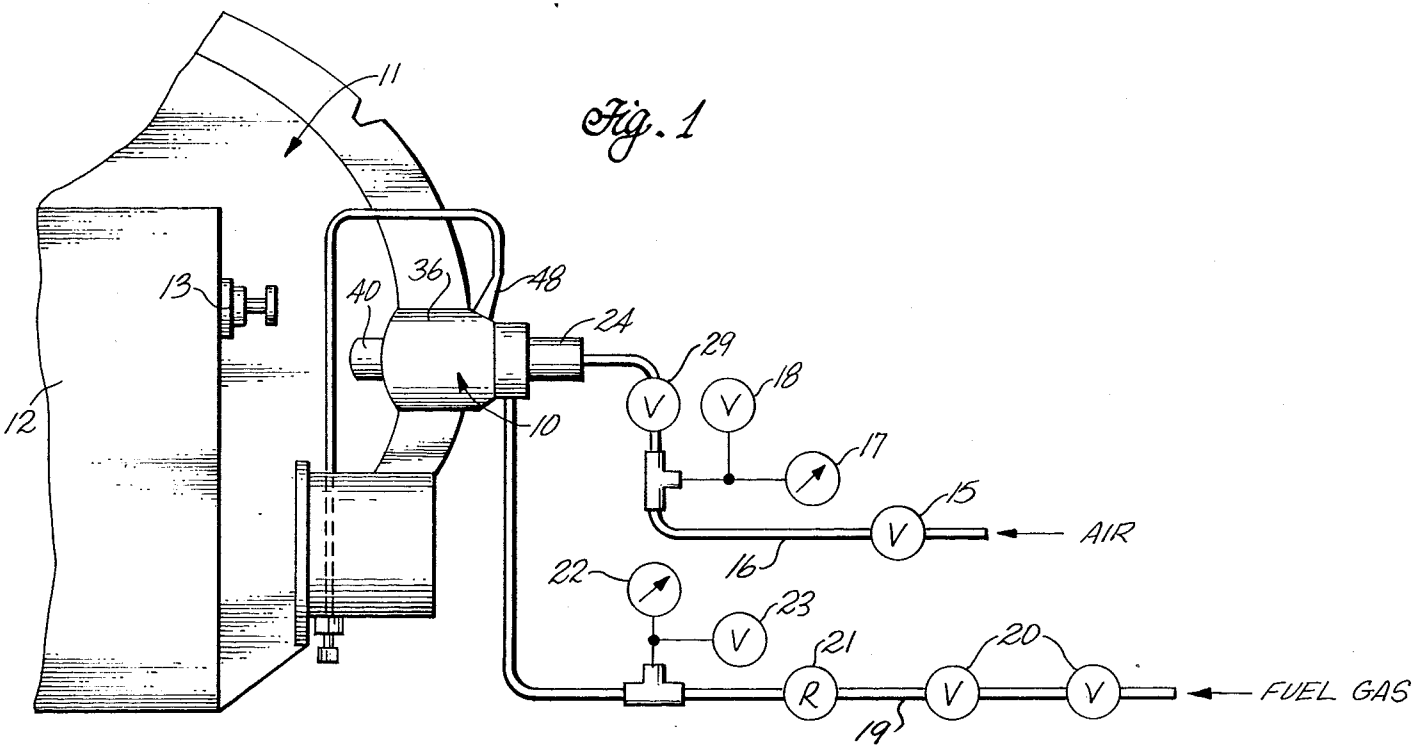
FIG. 1 is a semi-schematic illustration showing a gas pilot-igniter according to principles of this invention for igniting combustible gases in a burner.

The invention is especially useful for igniting the main flame of forced draft burners. The pilot flame has sufficient flame strength and velocity to withstand the high velocity blast of the forced draft burner. The gas pilot-igniter also will burn a variety of fuel gases over a broad operating range of gas flow rates and pressures. FIG. 1 shows a gas pilot-igniter 10 according to this invention used in a forced draft burner 11, to illustrate one example of the use of the invention. The burner assembly includes a blower housing 12 having an air tap 13 which can be used for the combustion air source for the pilot flame as an alternative to preferred compressed air. An external ignition transformer 14 provides the supporting electrical circuitry for controlling ignition of a fuel/air mixture in the pilot/igniter 10. An air source, preferably compressed air (instrument air) at about 5–20 cfm, supplies air to the pilot-igniter 10. The air flow rate is varied depending upon the type of fuel used, and is controlled by a needle valve 29 in an air inlet line 16. Air flow to the pilot-igniter is initially controlled by an on-off air solenoid valve 15 in the air inlet line 16. An air gauge 17 controlled by a valve 18 measures inlet air pressure in the line 16. A fuel gas source (propane, butane, well gas, etc.) supplies gas to the pilot igniter through a gas inlet line 19. Gas flow is controlled by solenoid valves 20 and a gas pressure regulator 21 for controlling pressure to from about 2 to 5 inches of mercury. The gas pressure is varied depending upon the type of fuel used. A gas pressure gauge 22 controlled by a valve 23 measures inlet gas pressure. The fuel and air are mixed in the pilot-igniter and ignited to produce an ignition flame for igniting the main flame in the burner.

Figure 2:
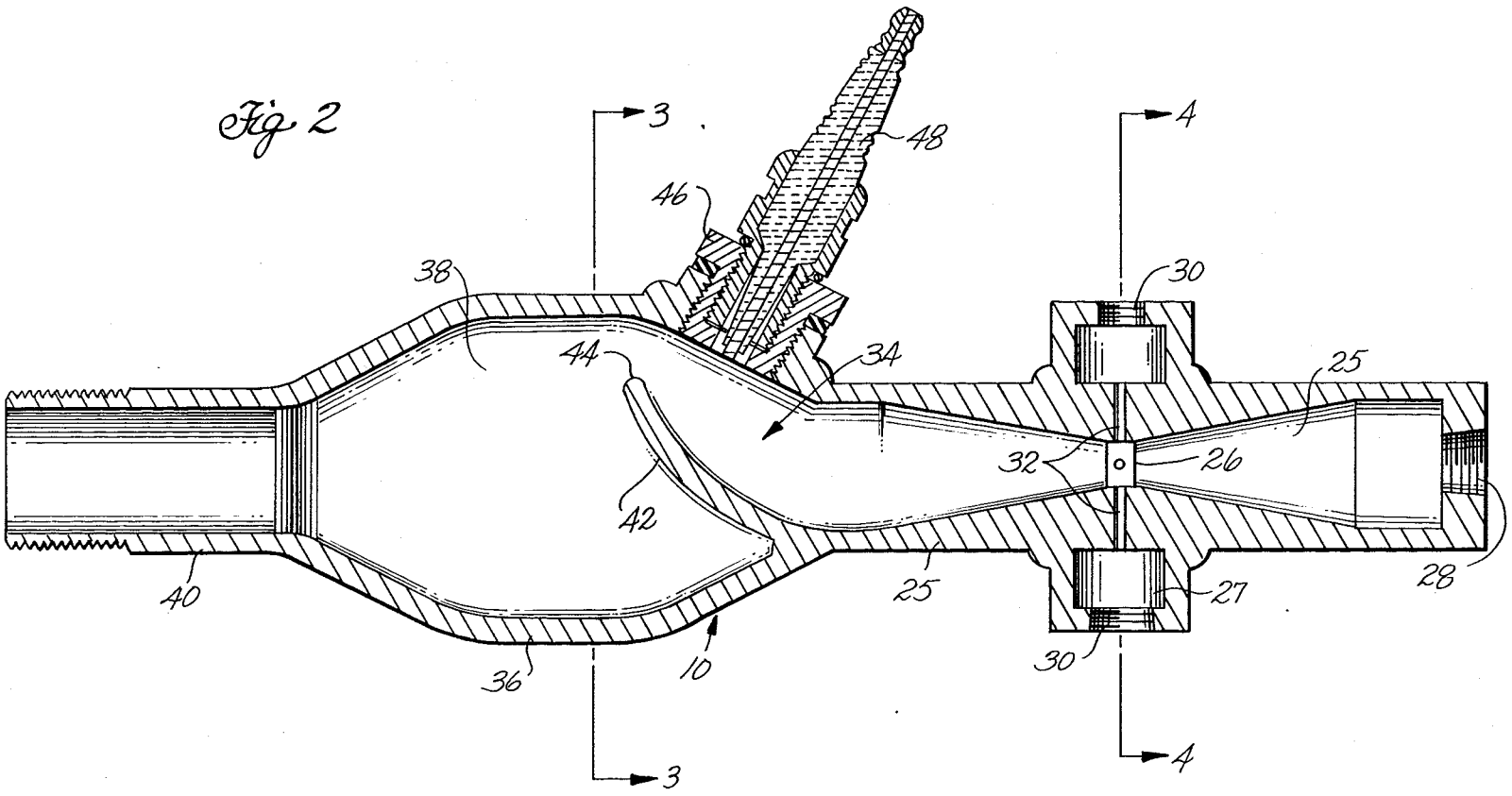
FIG. 2 is a longitudinal cross-sectional view illustrating components of the gas pilot-igniter.
Figure 4:
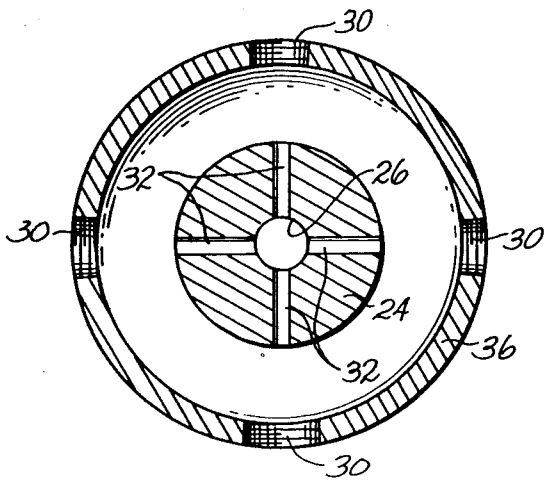
FIG. 4 is a cross-sectional view taken on line 4—4 of FIG. 2.
Figure 3:
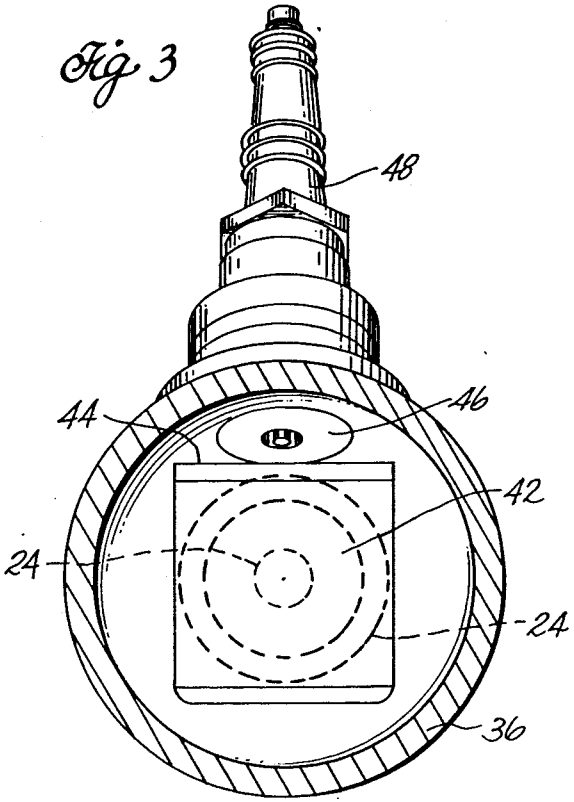
FIG. 3 is a cross-sectional view taken on line 3—3 of FIG. 2.

Referring to FIGS. 2 through 4, the gas pilot-igniter 10 includes a generally cylindrical steel housing 24 encompassing an air inlet manifold 25, a primary fuel and air mixing venturi 26, and a fuel gas manifold 27. Compressed air used for combustion air is regulated through an orifice 28 entering the air inlet manifold 25. The combustion air thus flows under pressure directly toward the venturi 26 for primary mixing with the fuel gas.

The fuel gas manifold 27 extends around the venturi and fuel gas under pressure enters the fuel gas manifold through fuel gas inlets 30 leading to respective narrow drilled orifices 32, preferably at 90° intervals, for delivering the fuel gas under pressure to the venturi. Depending upon the type of fuel gas used, it is possible to burn a very lean mixture of gas (such as propane, well gas, methane, etc.) with air due to the complete mixing as well as turbulence created by the venturi, in addition to the secondary mixing in the pre-combustion chamber described below.

Following primary mixing in the venturi, the fuel/air mixture passes to a pre-combustion chamber 34 downstream from the venturi. The pre-combustion chamber is also located in an upstream region of a main combustion chamber housing 36. The pre-combustion chamber 34 is in a necked down inlet region of the main combustion chamber. Downstream from the pre-combustion chamber the primary combustion chamber housing 36 tapers wider in inside diameter to form a maximum diameter principal interior region 38 of the main combustion chamber. A narrow outlet nozzle 40 extends away from the downstream end of the main combustion chamber 36.

The elongated inlet housing 24 at the inlet end of the gas pilot-igniter extends away from the venturi toward the inlet end of the main combustion chamber. The upstream end of the main combustion chamber is partially formed by a baffle plate 42 which extends axially along a curved path from below the downstream end of the mixing venturi to a position which blocks the flow of the fuel/air mixture entering the pre-combustion chamber. The baffle plate is generally rectangular in lateral configuration, as shown in FIG. 3, and it extends from the bottom of the pre-combustion chamber, along the curved path into the main combustion chamber and to an upper end 44 which is spaced below the upper wall of the main combustion chamber.

The pre-combustion chamber has a stainless steel firing cup 46 threaded into an opening in the wall of the housing and facing toward the baffle plate 42. A spark plug 48 is threaded into the firing cup with its electrode positioned above the pre-combustion chamber. The spark plug can be similar to a hot automotive spark plug with no ground electrode. The ground electrode is provided by the firing cup. The spark plug is controlled by a high intensity coil to produce a high intensity spark.

During use of the pilot-igniter, compressed air is introduced into the air inlet 28 and fills the air inlet manifold 25 and then enters the primary fuel/air mixing venturi 26. Concurrently, pressurized fuel gas enters the fuel inlet 30 and fills the fuel gas manifold 27. A low pressure is created at the fuel/gas orifices 32 by the compressed air flowing through the primary mixing venturi. Primary fuel/air mixing occurs in the venturi, and the fuel and air mixture fills the crescent-shaped pre-combustion chamber 34 formed by the baffle plate 42 in the path of the on-coming fuel/air mixture. Secondary fuel and air mixing and stratification occurs at this point in the pre-combustion chamber due to turbulence created by the disruption of flow created by the baffle. A major portion of the fuel/air mixture subjected to secondary mixing in the pre-combustion chamber is directed toward the spark plug 48 which fires into the stainless steel firing cup 46 so that ignition occurs in the pre-combustion chamber. Concurrently, the balance of the fuel/air mixture spills over the sides of the baffle, filling the main combustion chamber 38. The fuel and air passing into the main combustion chamber are ignited (in the main combustion chamber) by the flame from the pre-combustion chamber. This constantly regenerates the flame, and the burning fuel and air mixture expands and exits the outlet nozzle 40. The outlet flame is in the flow path of the main burner fuel/air mixture, for igniting the main burner.

The gas pilot-igniter of this invention operates on very lean fuel/air mixture without flameout. It will burn dirty or low BTU content gas. It tolerates fluctuating fuel pressure or fuel quality. The fuel/air mixing is complete due to the venturi for primary mixing and the turbulence baffle for secondary mixing and stratification of the fuel/air mixture created by the baffle. The resulting flame strength is thereby sufficient to avoid flameout in high velocity gas streams.

What is claimed is:

1. A gas pilot-igniter for use in igniting combustible gases in a main burner, the gas pilot-igniter including:

air inlet means for supplying air under pressure to a primary mixing chamber which includes a mixing venturi, a fuel gas inlet means for directing fuel gas under pressure into the mixing venturi for primary mixing with the air, the primary mixing chamber including an elongated conduit leading downstream from the mixing venturi to an outlet opening of the mixing chamber, so that a flow stream of the primary fuel/air mixture therein is propelled from the mixing venturi toward the outlet opening of the primary mixing chamber, a main combustion chamber comprising a tubular outer housing extending axially downstream from the primary mixing chamber, a pre-combustion chamber in an upstream region of the main combustion chamber, downstream from the primary mixing chamber, the outlet from the primary mixing chamber opening into the pre-combustion chamber, the pre-combustion chamber being formed between said outer housing and an elongated baffle plate spaced from said outer housing and extending from a first wall portion of the outer housing and across the outlet opening of the primary mixing chamber in a downstream direction to form the pre-combustion chamber as an elongated open passageway which tapers narrower in cross section from the outlet of the primary mixing chamber toward a discharge end of the baffle plate, the baffle plate being positioned in the path of the flow stream of the fuel/air mixture propelled away from the primary mixing chamber for creating turbulence and secondary mixing of the fuel/air mixture in a reduced diameter portion of the pre-combustion chamber defined between the discharge end of the baffle plate and a second wall portion of the outer housing and downstream from the primary mixing chamber, the baffle plate providing means for guiding the fuel/air mixture to an igniter means adjacent the discharge end of the baffle plate in the reduced diameter portion of the pre-combustion chamber for igniting the fuel/air mixture therein to produce a pre-combustion flame directed in a downstream direction away from the discharge end of the baffle plate, the baffle plate dimensioned to allow a remaining portion of the fuel/air mixture to flow freely between the outer housing and around sides of the baffle plate and away from the pre-combustion chamber and into the main combustion chamber where the remaining fuel/air mixture is ignited by the pre-combustion flame, thereby producing a pilot flame which exits a pilot outlet means from the main combustion chamber to ignite the main burner fuel/air mixture.

2. Apparatus according to claim 1 in which the baffle plate is affixed to an internal wall of the at a position downstream the outlet opening from the primary mixing chamber, and the baffle plate is curved along a path extending downstream opening of the primary mixing chamber and into the main combustion chamber and downstream of the igniter means, for forming the a wall portion of the pre-combustion chamber as an elongated progressively tapered passage between the primary mixing chamber and the igniter means in the main combustion chamber.

3. Apparatus according to claim 2 in which the igniter means comprises a spark plug.

4. Apparatus according to claim 1 including fuel gas orifices through which fuel gas enters the primary fuel and air mixing venturi.

5. Apparatus according to claim 1 in which the igniter means comprises a spark plug having a first electrode, and in which the spark plug is mounted in a firing cup in the pre-combustion chamber forming a second electrode of the spark plug surrounding the first electrode, the spark plug firing into the firing cup via supporting electrical circuits.

6. Apparatus according to claim 1 in which the mixing venturi is at a minimum diameter region of the elongated primary mixing chamber, and including fuel gas orifices spaced circumferentially around the minimum diameter region of the venturi, and in which the fuel gas enters the fuel gas orifices under pressure for mixing with the air supplied to the mixing venturi.

7. Apparatus according to claim 2 in which the mixing venturi is at a minimum diameter region of the elongated primary mixing chamber, and including fuel gas orifices spaced circumferentially around the minimum diameter region of the venturi, and in which the fuel gas enters the fuel gas orifices under pressure for mixing with the air supplied to the mixing venturi.

8. A gas pilot-igniter for use in igniting combustible gases in a main burner, the gas pilot-igniter including:

an elongated tubular housing having a primary mixing chamber, a secondary mixing chamber downstream from the primary mixing chamber, and a main combustion chamber downstream from the secondary mixing chamber, the primary mixing chamber having an elongated first section tapering narrower toward a region of reduced diameter forming a mixing venturi and an elongated second section tapering wider away from the mixing venturi toward an outlet opening thereof communicating with the secondary mixing chamber, means supplying air under pressure to the venturi region of the primary mixing chamber, p1 fuel gas inlet means directing fuel gas under pressure into the mixing venturi for primary mixing with the air in the primary mixing chamber, the air and fuel gas directed under pressure into the primary mixing chamber producing a fuel/air mixture propelled from the primary mixing chamber toward the outlet thereof and into the pre-combustion chamber, the pre-combustion chamber being formed by an elongated baffle plate extending from a first wall portion of the housing adjacent the outlet opening of the primary mixing chamber along a downstream path spaced from a wall of the housing cooperating with the baffle plate to thereby form the pre-combustion chamber as an elongated open passageway of progressively reduced cross section leading from the outlet of the primary mixing chamber toward a downstream end of the baffle plate spaced closely apart from a second wall portion of the housing to form a discharge end of the pre-combustion chamber, igniter means in the pre-combustion chamber adjacent the discharge end of the baffle, the pre-combustion chamber providing a means for guiding the flowstream of the fuel/air mixture propelled from the primary mixing chamber toward the igniter means and for creating turbulence and secondary mixing of the fuel/air mixture in the reduced diameter portion of the pre-combustion chamber adjacent the igniter means, for igniting the fuel/air mixture to produce a pre-combustion flame directed downstream past the discharge end of the baffle plate, the baffle plate dimensioned to allow a remaining portion of the fuel/air mixture to flow freely between the wall of the housing and around sides of the baffle plate and away from the pre-combustion chamber and into the main combustion chamber where the remaining fuel air-mixture is ignited by the pre-combustion flame, thereby producing a pilot flame which exits a pilot outlet means from the main combustion chamber to ignite the main burner fuel/air mixture.

9. Apparatus according to claim 8 in which the baffle plate is curved along its path extending toward the igniter means.

10. Apparatus according to claim 9 in which the igniter means comprises a spark plug.

11. Apparatus according to claim 10 in which the spark plug has a first electrode and in which the spark plug is mounted in a firing cup in the pre-combustion chamber for forming a second electrode of the spark plug and surrounding the first electrode, the spark plug firing into the firing cup via supporting electrical circuits.

* * * * *